US010143878B2

(12) United States Patent
Gottfried

(10) Patent No.: US 10,143,878 B2
(45) Date of Patent: Dec. 4, 2018

(54) RESISTANCE SHIRT FOR MUSCLE TONING

(71) Applicant: Ofer Gottfried, Tzur Moshe (IL)

(72) Inventor: Ofer Gottfried, Tzur Moshe (IL)

( * ) Notice: Subject to any disclaimer, the term of this patent is extended or adjusted under 35 U.S.C. 154(b) by 380 days.

(21) Appl. No.: 14/973,898

(22) Filed: Dec. 18, 2015

(65) Prior Publication Data

US 2016/0199684 A1 Jul. 14, 2016

Related U.S. Application Data

(60) Provisional application No. 62/102,032, filed on Jan. 11, 2015.

(51) Int. Cl.

| | |
|---|---|
| ***A63B 21/055*** | (2006.01) |
| ***A41B 1/08*** | (2006.01) |
| *A63B 21/00* | (2006.01) |
| *A63B 21/04* | (2006.01) |

(52) U.S. Cl.

CPC ..... *A63B 21/0552* (2013.01); *A41B 1/08* (2013.01); *A63B 21/4025* (2015.10); *A63B 21/0442* (2013.01); *A63B 21/0555* (2013.01); *A63B 21/4005* (2015.10); *A63B 21/4007* (2015.10); *A63B 21/4009* (2015.10); *A63B 21/4017* (2015.10); *A63B 21/4021* (2015.10)

(58) Field of Classification Search

CPC ..... A41B 1/08
USPC ..... 2/69
See application file for complete search history.

(56) References Cited

U.S. PATENT DOCUMENTS

| | | | | |
|---|---|---|---|---|
| 4,910,802 | A * | 3/1990 | Malloy | A41D 13/0015 2/227 |
| 5,308,305 | A * | 5/1994 | Romney | A63B 21/4025 2/69 |
| 5,570,472 | A | 11/1996 | Dicker | |
| 5,720,042 | A * | 2/1998 | Wilkinson | A41D 13/0015 2/69 |
| 5,829,058 | A * | 11/1998 | Dicker | A41D 13/0015 2/69 |
| 5,839,122 | A * | 11/1998 | Dicker | A41D 7/00 2/67 |
| 5,857,947 | A * | 1/1999 | Dicker | A63B 21/00185 2/69.5 |
| 2007/0271668 | A1* | 11/2007 | Pape | A41D 13/0015 2/69 |
| 2009/0042702 | A1* | 2/2009 | Toronto | A63B 21/0552 482/124 |
| 2013/0067628 | A1 | 3/2013 | Harb | |
| 2014/0325732 | A1* | 11/2014 | Anderson | A63B 21/00185 2/69 |

* cited by examiner

*Primary Examiner* — Katherine Moran
(74) *Attorney, Agent, or Firm* — The Law Office of Joseph L. Felber

(57) ABSTRACT

A movement resistance shirt for providing muscle toning to a user wearing the shirt. The shirt including a pair of semi-rigid shoulder anchors each configured to circle a shoulder of the user and a pair of long elastic bands each extending between first and second ends. A second end of at least one of said pair of long elastic band dangles out of a cuff of said shirt, and each one of the long elastic band is attached at its other first end to a respective one of the shoulder anchors.

15 Claims, 6 Drawing Sheets

RESISTANCE SHIRT FOR MUSCLE TONING

FIELD OF THE INVENTION

The present invention relates generally to sportswear, and more particularly to clothes that resist muscle movement for muscle toning.

BACKGROUND OF THE INVENTION

The field of resistance exercise clothing is known and is gaining popularity. The objective of these clothes is to increase muscle toning while exercising, by using the clothes to resist muscle movement. The resistance is achieved by various means, mostly by using elastic bands, as shown in U.S. Pat. No. 5,570,472 to Dicker and US Pub. No. 2013/0067628. The wearer of the resistance exercise clothes achieves greater muscular activity while exercising, compared to exercising while wearing regular clothes.

Many types of resistance clothes are uncomfortable for the wearer, therefore there is a need for improved resistance clothes. It would also be beneficial to wear resistance clothes while performing regular daily activities, so as to utilize the hours of the day for body toning, especially since there are many people who cannot find the time for exercising.

SUMMARY OF THE INVENTION

Accordingly, it is a principal object of the present invention to overcome the limitations of prior art movement resistance shirts by providing a shirt that is more effective, comfortable and suitable for daily activities In accordance with a preferred embodiment of the present invention, there is provided a movement resistance shirt for providing muscle toning, said shirt comprising:

- a pair of semi-rigid shoulder anchors each circling a shoulder;
- a pair of long elastic bands threaded into said resistance shirt, wherein one end of one of said pair of said elastic band is configured to extend out of the cuffs of said shirt, wherein each said long elastic band is attached on its other end to each of said shoulder anchors, and wherein said shoulder anchors substantially prevent or limit said shirt from riding up on at least one side of the users body and/or said shoulder anchors substantially fix the shirt in place on a users' body, in particular in the shoulder area, against unintended movement or riding up of the shirt due inter alia to the elastic bands;

The shirt in one embodiment may be provided with a wide elastic band surrounding the body at the bottom of the rib cage and possibly threaded into said shirt;

In addition, a pair of short elastic bands may be provided, wherein one end of said short elastic band is attached to said wide elastic band and the other end is attached to said shirt at the elbow area;

such that said long and short elastic bands provide resistance to the daily body movements, thereby toning the muscles.

The resistance shirt has long sleeves and has semi-rigid shoulder anchors circling each shoulder, diagonally, from near the side of the neck and under the armpits. One end of a long elastic band is attached to the shoulder anchor near the armpit area and is threaded along the sleeve, and the other end of the long band dangles out of the cuff of the sleeve. The other end of the band is either attached to a glove to be worn on the users' hand, or is tied into a loop to be fitted around the users thumb. When the user stretches his arms, the band is pulled and the shoulder anchor anchors the band so that it doesn't pull the shirt.

An additional wide band surrounds the body at the bottom of the rib cage, and is threaded into the shirt. An elastic short band is attached to the wide band on either side of the shirt and is threaded into the shirt up to the armpit and then down to the elbow area. The elastic short band provides tension of the shoulder muscles when the arms are lifted away from the body The resistance shirt provides resistance to many more body movements than the prior art sportswear, such as arms stretching and raising, chest movement, shoulder movement and more.

In accordance with the present invention the design of using anchors allows higher efficiency of resistance training and tones more muscles than the known resistive sportswear.

In accordance with a further embodiment of the present invention, the resistance shirt has a semi-rigid elbow anchor surrounding the arm beneath the elbow. The elbow anchor anchors the short band on one end.

In accordance with yet a further embodiment of the present invention, the resistance shirt is provided as a base without sleeves, having the anchors and bands, and any shirt can be worn over it.

In accordance with even yet a further embodiment of the present invention, the resistance shirt may be in a form of a sweatshirt with a front zipper.

Additional features and advantages will become apparent from the following drawings and description.

BRIEF DESCRIPTION OF THE DRAWINGS

For a better understanding of the invention with regard to the embodiments thereof, reference is made to the accompanying drawings, in which like numerals designate corresponding elements or sections throughout, and in which.

DETAILED DESCRIPTION OF THE PREFERRED EMBODIMENTS

It is a principal object of the present invention to provide a resistance shirt for muscle toning for use during exercise or during daily activities.

Figure 1:
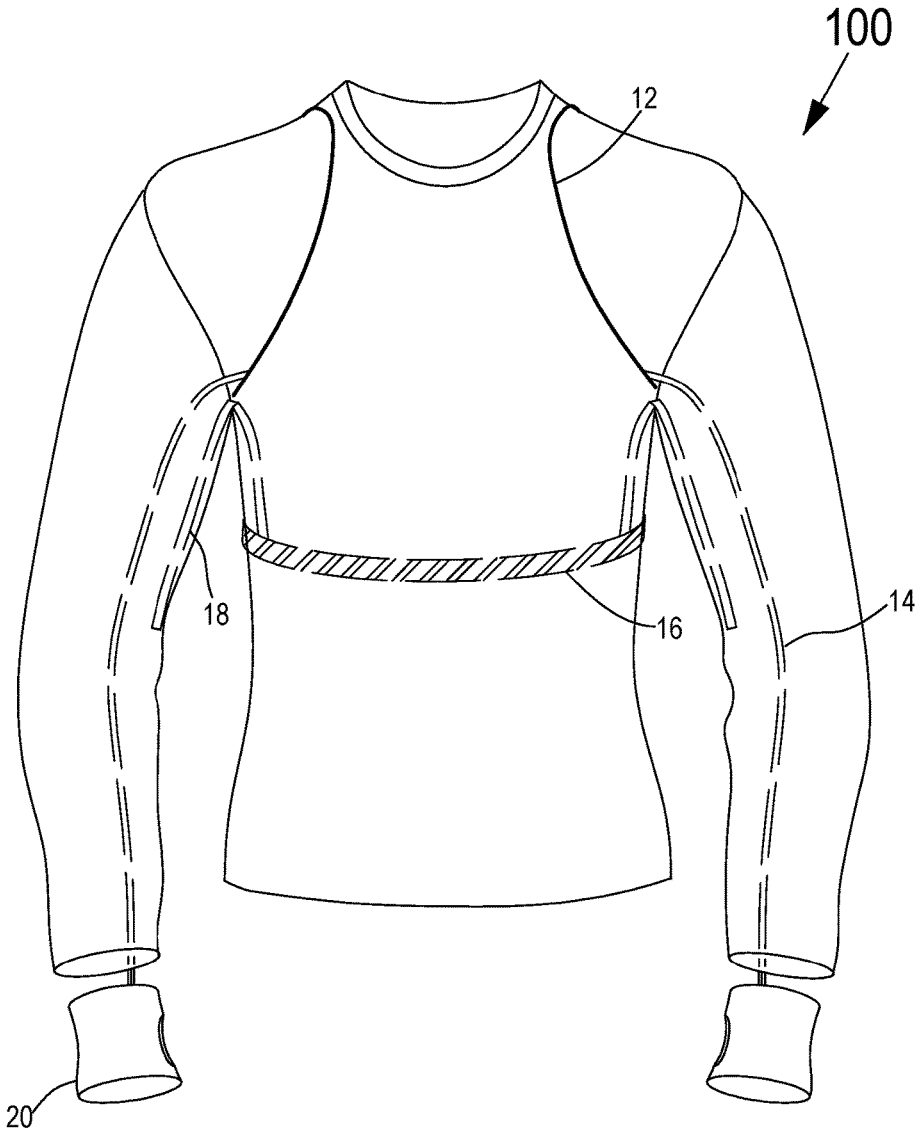
FIG. 1 shows the front of a resistance shirt according to a preferred embodiment of the present invention.

Referring now to FIG. 1, there is shown an embodiment of a long-sleeved resistance shirt 100, having semi-rigid shoulder anchors 12 circling each shoulder, diagonally, from near the side of the neck and under the armpits. Shirt 100 includes two elastic long bands 14 with each band being associated with a respective sleeve and shoulder anchor of the shirt. In an embodiment, one first end of each elastic long band 14 is attached to its associated shoulder anchor 12 near the armpit and extends along the sleeve possibly threaded along the sleeve. The other second end of long band 14 may in some embodiments dangle out of the cuff of the sleeve. In other embodiments, the other second end of long band 14 may extend in a non-stretched state to a location still within the sleeve, i.e. not beyond the cuff, and thus urging of the second end to extend beyond and out of the sleeve via the cuff involves stretching of the band 14. The other second end of band 14 may either be attached to a glove 20 to be worn on the users' hand, or may be tied into a loop to be fitted around the users thumb (see FIG. 4B).

In an embodiment, the long bands 14 may be configured to start stretching and thereby resist movement of a user wearing the shirt, when such user attempts to straighten his hands. For example, the slightly bended arm positions in FIG. 1 may represent a state in which the bands 14 are already at least slightly stretched and thus an un-stretched state of the bands 14 in this case would be with the arms slightly more bended. In any case, any attempt to straighten an arm from at least this position would be against the resistance of the band 14 associated with said arm.

In an embodiment, an additional wide band 16 may surround the body possibly at the bottom of the rib cage, and may be threaded into shirt 100. An elastic short band 18 may be attached to wide band 16 on either side of the shirt and may be threaded into shirt 100 up to the armpit and then down to the elbow area. Elastic short band 18 may provide tension of the shoulder muscles when the arms are lifted away from the body (see FIG. 3).

The bands 14, 16 and 18 may have an insulating layer between them and the body, such as gel cushions (not shown), for increasing the comfort of the user.

All bands 14, 16 and 18 may have different tension levels which can be chosen and switched by the users' choice.

Shirt 100 is designed in such a way that tension is provided against muscle movement even during daily activities. For example, the bands 14 may resist straightening of the arms and the bands 18 may resist lifting of the arms away from the body.

In another preferred embodiment not shown, the resistance shirt may be in a form of a sweatshirt with a front zipper.

Figure 2:
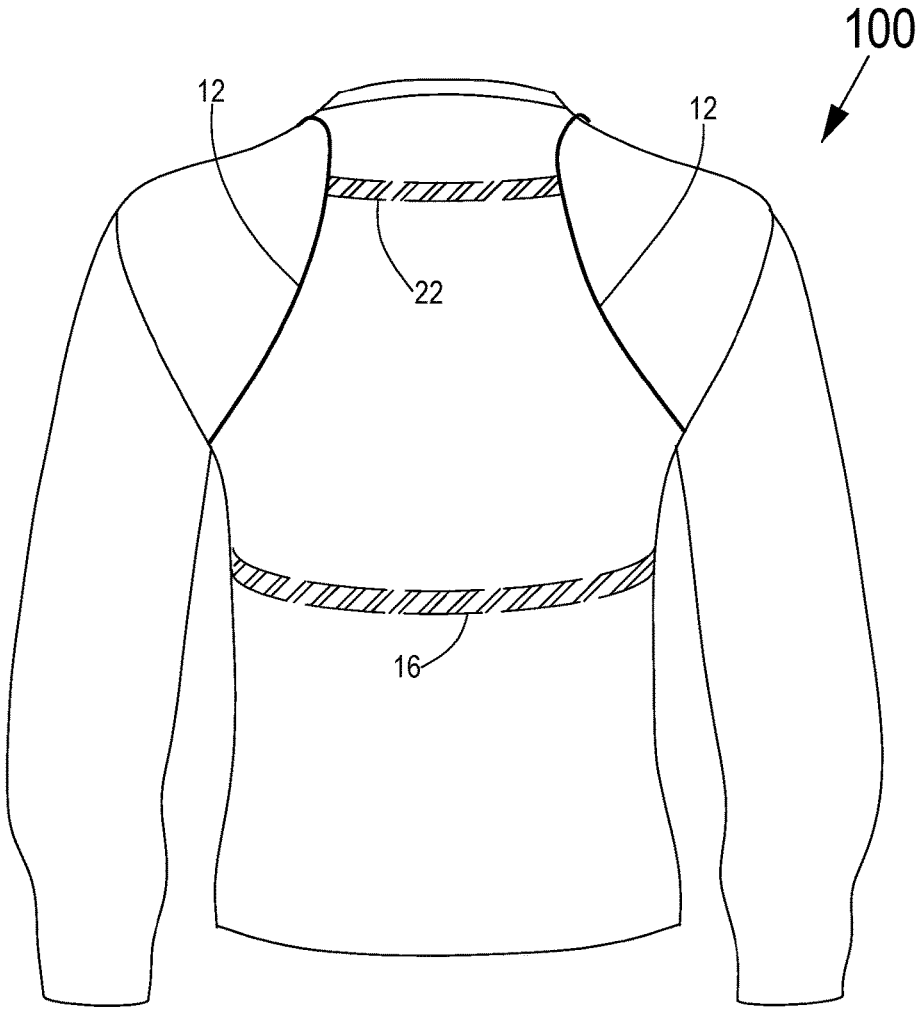
FIG. 2 shows a back view of the resistance shirt of FIG. 1.

Referring now to FIG. 2, there is shown a back view of resistance shirt 100, showing a connecting elastic band 22 which is attached on either end to shoulder anchors 12, and is positioned in the upper area between the shoulder blades. Band 22 connects shoulder anchors 12 to each other in order to further assist to position them in their place. Semi-rigid shoulder anchors 12 connected to bands 14, substantially prevent or limit shirt 100 from riding up the users body on at least one side while moving and/or said shoulder anchors substantially fix the shirt in place on a users' body, in particular in the shoulder area, against unintended movement or riding up of the shirt due inter alia to the elastic bands.

Figure 3:
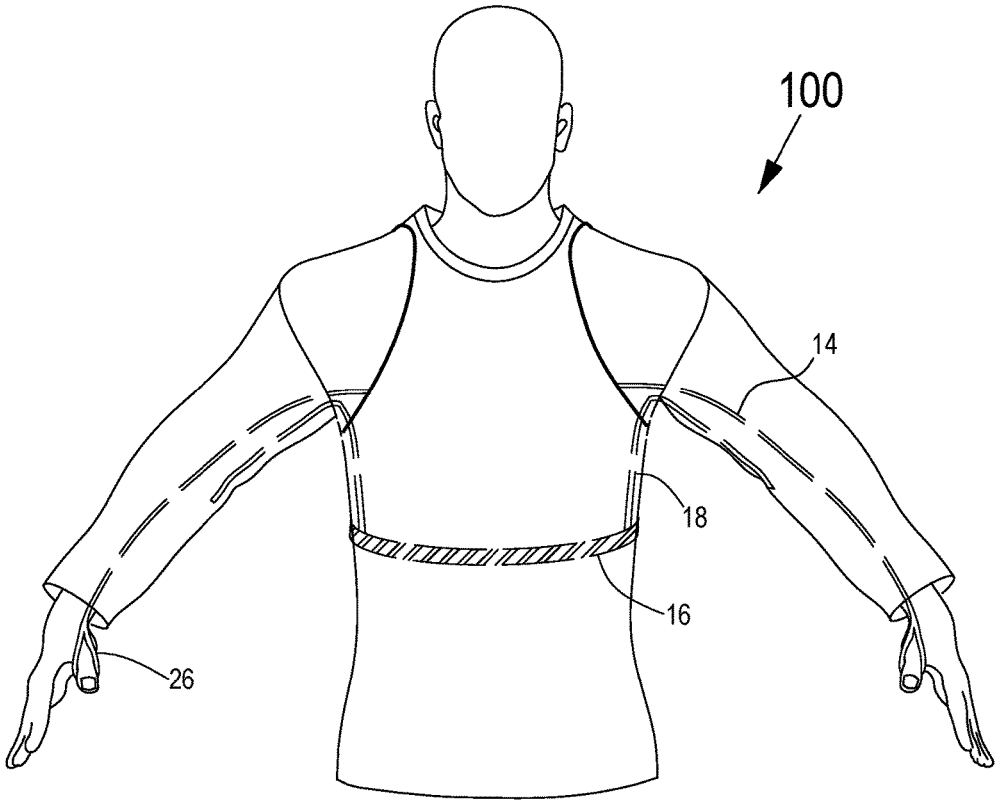
FIG. 3 shows the shirt of FIG. 1 worn by a user, having an elbow anchor.

Referring now to FIG. 3, there is shown a user wearing resistance shirt 100, having his arms spread to the sides, thereby flexing the shoulder muscles by stretching bands 18. Loop 26 on the end of band 14 dangling from or extending outside the sleeve may be attached to the users thumb so that band 14 is stretched and thereby provides resistance to the muscles.

Figure 4A:
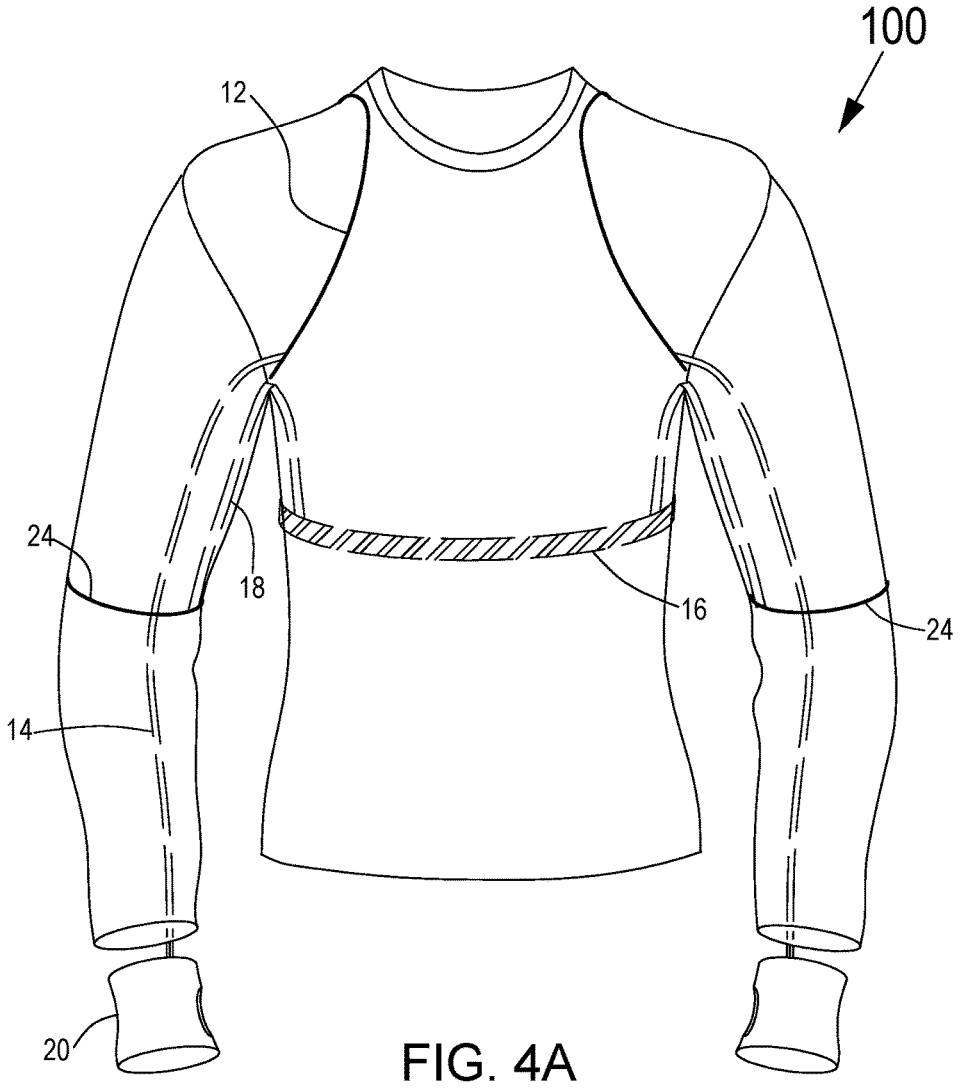
FIG. 4A shows the shirt of FIG. 3.

Referring now to FIG. 4A there is shown an alternative embodiment of the resistance shirt 100 having a semi-rigid elbow anchor 24 surrounding the arm beneath the elbow. Elbow anchor 24 anchors band 18 on one end. Band 14 in this embodiment is threaded along the sleeve and passes by anchor 24 to possibly be looped around it for the purpose of leading band 14 along its path.

Elbow anchor 24 may be embedded into shirt 100 and may not be visible from outside the shirt. It may be made of any suitable material that will be comfortable for the user, such as plastic, but not only.

Figure 4B:
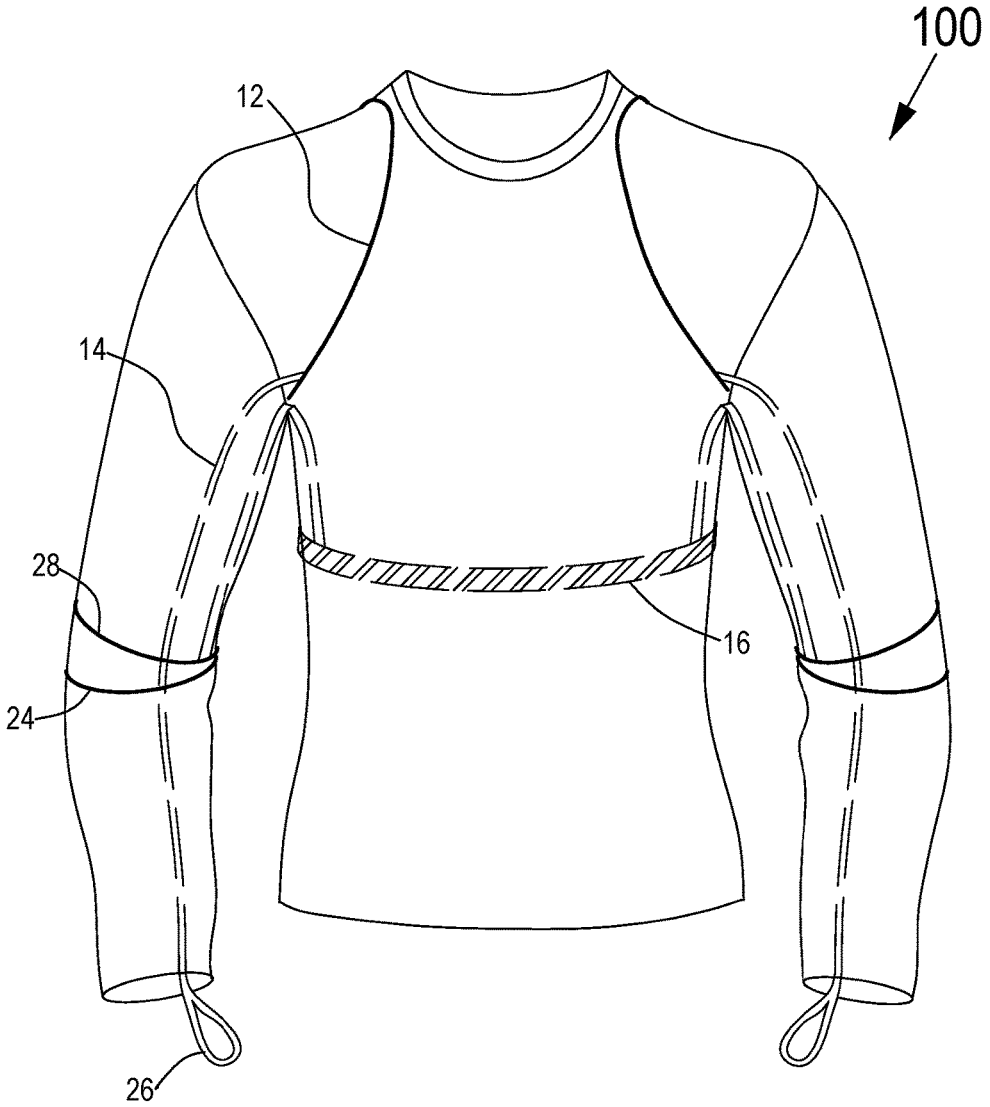
FIG. 4B shows a resistance shirt with two elbow anchors.

Referring now to FIG. 4B, there is shown an additional alternative embodiment of the resistance shirt 100 having two semi-rigid elbow anchors: bottom elbow anchor 24 below the elbow and top elbow anchor 28 above the elbow. The additional top elbow anchor 28 may increase the hold on band 18 and thereby will increase the resistance of band 18.

Figure 5:
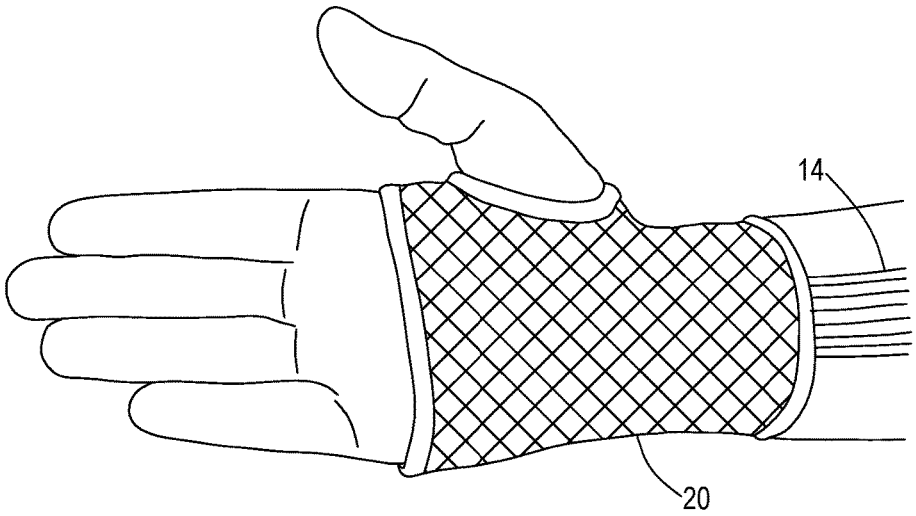
FIG. 5 shows a glove for connecting to a resistance shirt.

Referring now to FIG. 5, there is shown glove 20 worn on a users' hand, and attached at the wrist area to band 14. The end of glove 20 reaches only up to the middle of the palm of the hand so that the user is not restricted and can use his fingers freely.

Although particular embodiments of the invention have been described and illustrated herein, it is recognized that modifications and variations may readily occur to those skilled in the art and consequently, it is intended that the claims be interpreted to cover such modifications and equivalents.

I claim:

1. A movement resistance shirt for providing muscle toning to a user wearing the shirt during exercise or during daily activities, said shirt comprising:

a pair of shoulder anchors each configured to circle a shoulder of the user;

a pair of long elastic bands threaded into said resistance shirt to form an integral part of the shirt and each extending between first and second ends, a wide elastic band configured for surrounding the users' body at the bottom of the rib cage, and a pair of short elastic bands, wherein one first end of each short elastic band being attached to said wide elastic band and the other second end being attached to said shirt at a portion of the shirt configured to be the elbow area of the shirt, wherein a second end of at least one of said pair of long elastic bands is configured to extend out of a cuff of said shirt, and wherein each one of said long elastic band being attached at its other first end to a respective one of said shoulder anchors.

2. The shirt of claim 1, wherein said shoulder anchors being configured to prevent said shirt from riding up and/or sideways on the users' body.

3. The shirt of claim 1, wherein said long and short elastic bands being configured to provide resistance to daily body movements, thereby toning the muscles.

4. The shirt of claim 1, wherein circling of a shoulder by each said shoulder anchor is diagonally from near a side of a neck of the shirt and under an armpit of the shirt.

5. The shirt of claim 1, wherein said second end being configured to extend out of the cuff by stretching the band to position the second end beyond the cuff.

6. The shirt of claim 5, wherein said second end being attached to a glove to be worn on a user's hand.

7. The shirt of claim 5, wherein said second end being tied into a loop to be fitted around a users' thumb.

8. The shirt of claim 1 and comprising a connecting elastic band attached on either end to a respective one of the shoulder anchors, wherein said connecting elastic band being configured to be positioned in an upper area of the shirt between the shoulder blades of a user.

9. The shirt of claim 1 and comprising a pair of elbow anchors, wherein each such elbow anchor being configured to surround a users' arm beneath the elbow and being connected to a respective one of the short elastic bands at the second end of the short elastic band.

10. The shirt of claim 9, wherein each long elastic band being looped around a respective one of the elbow anchors when extending along the arm.

11. The shirt of claim 9 and comprising an additional pair of elbow anchors, wherein each such additional elbow anchor being configured to surround a users' arm above the elbow.

12. A method for providing muscle toning during exercise or during daily activities comprising the steps of:

providing a movement resistance shirt comprising a pair of shoulder anchors and a pair of long elastic bands threaded into said resistance shirt to form an integral part of the shirt, such that when a user wears the shirt each shoulder anchor is configured to circle a respective shoulder of the user and each long elastic band comprises one second end being configured to extend out of a cuff of the shirt to be coupled to a respective hand of the user and an opposing other first end attached to a respective one of said shoulder anchors, wherein at least straightening the users' arms is adapted to flex at least some muscles of the user by stretching the long bands, and the movement resistance shirt further comprising a wide elastic band and a pair of short elastic bands, the wide elastic band being configured to surround the user's body at the bottom of the rib cage and one end of each short elastic band being attached to said wide elastic band and the other end being attached to the shirt at a portion of the shirt configured to be adjacent the elbow area of the user, wherein spreading the users' arms to the sides is adapted to flex at least some muscles of the user by stretching the short bands.

13. The method of claim 12, wherein the shoulder anchors being configured to prevent the shirt from riding up and/or sideways on the user's body during at least movement of the arms.

14. The method of claim 12 and comprising a connecting elastic band attached on either end to a respective one of the shoulder anchors, wherein said connecting elastic band being configured to be positioned in an upper area of the shirt between the shoulder blades of a user.

15. The method of claim 13 and comprising a wide elastic band and a pair of short elastic bands, the wide elastic band being configured to surround the user's body at the bottom of the rib cage and one end of each short elastic band being attached to said wide elastic band and the other end being attached to the shirt at a portion of the shirt configured to be adjacent the elbow area of the user, wherein spreading the users' arms to the sides is adapted to flex at least some muscles of the user by stretching the short bands.

* * * * *